US006981291B2

(12) United States Patent
McKay

(10) Patent No.: US 6,981,291 B2
(45) Date of Patent: Jan. 3, 2006

(54) MOTORIZED CLEANING APPARATUS

(75) Inventor: William D. McKay, Grand Blanc, MI (US)

(73) Assignee: The Hartz Mountain Corporation, Secaucus, NJ (US)

( * ) Notice: Subject to any disclaimer, the term of this patent is extended or adjusted under 35 U.S.C. 154(b) by 0 days.

(21) Appl. No.: 10/755,494

(22) Filed: Jan. 12, 2004

(65) Prior Publication Data

US 2005/0091772 A1 May 5, 2005

Related U.S. Application Data

(63) Continuation-in-part of application No. 10/717,956, filed on Nov. 20, 2003, which is a continuation-in-part of application No. 10/672,909, filed on Sep. 26, 2003.

(51) Int. Cl.
*A46B 13/02* (2006.01)
*A46B 13/04* (2006.01)

(52) U.S. Cl. ..... 15/23; 15/24; 15/28; 15/29; 15/97.1; 15/179; 15/230.19

(58) Field of Classification Search ..... 15/23, 15/24, 28–29, 97.1, 179, 181, 230, 230.19, 15/230.17, 230.16, 180
See application file for complete search history.

(56) References Cited

U.S. PATENT DOCUMENTS

| | | | | |
|---|---|---|---|---|
| 717,377 A | | 12/1902 | Flanders | |
| 2,529,927 A | | 11/1950 | Fisk | |
| 2,694,826 A | | 11/1954 | Blakely | |
| 3,011,499 A | | 12/1961 | Tajan | 401/139 |
| 3,056,154 A | | 10/1962 | Neal | 15/104 |
| 3,102,544 A | | 9/1963 | Keegan et al. | 132/147 |
| 3,158,887 A | | 12/1964 | Kanbar et al. | 15/104 |
| 3,299,461 A | | 1/1967 | Marks | 15/104 |
| 3,307,211 A | * | 3/1967 | Gaines | 15/4 |
| 3,373,457 A | | 3/1968 | Rouch, Jr. | 15/104 |
| 3,500,490 A | * | 3/1970 | Teren | 15/97.1 |
| 3,665,543 A | | 5/1972 | Nappi | 15/215 |
| 3,742,547 A | | 7/1973 | Sohmer | 15/104 |
| 3,755,847 A | | 9/1973 | Liebscher | |
| 3,833,008 A | | 9/1974 | Blackett, Jr. | |
| 3,890,984 A | * | 6/1975 | Lesetar | 132/271 |
| 4,062,083 A | | 12/1977 | McKay | 15/106 |
| 4,107,811 A | | 8/1978 | Imsande | 15/215 |
| 4,244,587 A | | 1/1981 | Schweizer | 15/104.8 |
| 4,307,739 A | | 12/1981 | Chern | |
| 4,361,923 A | | 12/1982 | McKay | 15/104 |
| 4,399,579 A | | 8/1983 | McKay | 15/104 |
| 4,422,201 A | | 12/1983 | McKay | 15/104 |
| 4,517,703 A | | 5/1985 | Koke | |
| 4,727,616 A | | 3/1988 | Kucera et al. | 15/104 |
| 4,850,073 A | | 7/1989 | Preuss | 15/207.2 |

(Continued)

*Primary Examiner*—John Kim
*Assistant Examiner*—S Balsis
(74) *Attorney, Agent, or Firm*—Jeffrey M. Kaden; Gottlieb, Rackman & Reisman, P.C.

(57) ABSTRACT

A cleaning apparatus includes a handle, a support rotatably coupled to the handle for rotation by a drive motor mounted in the handle and a cleaning element mountable on the support. The cleaning element a flexible mat fixed about the support or about a core mountable on the support. An auxiliary cleaning element attachment may be mounted on the end wall of the support. A liquid container may be mounted in the support or used to form the support to dispense fluid to the cleaning element disposed about the support.

18 Claims, 10 Drawing Sheets

U.S. PATENT DOCUMENTS 4,856,541 A 8/1989 Kellett et al.
4,905,337 A 3/1990 McKay ..... 15/104
5,002,075 A 3/1991 Kellett et al.
5,027,465 A 7/1991 McKay ..... 15/104
D320,680 S 10/1991 Stetson et al. ..... D30/158
5,052,071 A 10/1991 Halm ..... 15/167.1
5,261,426 A 11/1993 Kellett et al.
D342,610 S 12/1993 Stetson et al. ..... D4/122
D363,214 S 10/1995 Parola et al. ..... D9/300
5,519,912 A 5/1996 Kawamura
5,600,865 A 2/1997 Morrison
5,651,158 A 7/1997 Halm ..... 15/167.1
5,819,989 A 10/1998 Saraceni ..... 221/192
5,862,563 A 1/1999 Hartmann
5,870,790 A * 2/1999 Root et al. ..... 15/22.1
5,878,457 A 3/1999 Cox et al. ..... 15/104.002
5,887,600 A 3/1999 Wilk
5,890,249 A * 4/1999 Hoffman ..... 15/4
5,890,255 A 4/1999 Robinson
5,904,150 A 5/1999 Caristo et al.
6,006,393 A 12/1999 Lynch et al. ..... 15/144.1
6,014,788 A 1/2000 Jaffri ..... 15/104.002
6,021,542 A 2/2000 Norman
6,029,307 A 2/2000 Baudoin
6,055,695 A 5/2000 McKay, Jr. ..... 15/104.002
6,070,597 A 6/2000 Motherhead
6,098,635 A 8/2000 Marino ..... 132/238
6,112,362 A 9/2000 Parko et al.
6,127,014 A 10/2000 McKay, Jr. ..... 428/43
6,170,107 B1 * 1/2001 George et al. ..... 15/24
6,230,716 B1 5/2001 Minolatti
6,280,757 B1 8/2001 McAfee et al. ..... 424/402
6,298,517 B1 10/2001 McKay ..... 15/228
6,325,070 B1 12/2001 Tyroler et al. ..... 132/112
6,405,403 B1 6/2002 McKay ..... 15/228
6,502,585 B1 1/2003 Mazzei et al.
2003/0116171 A1 6/2003 Loveless
2003/0229958 A1 12/2003 Thompson et al.
2004/0181892 A1 9/2004 Chen

* cited by examiner

MOTORIZED CLEANING APPARATUS

CROSS REFERENCE TO CO-PENDING APPLICATIONS

This application is a continuation-in-part of co-pending application Ser. No. 10/717,956, filed Nov. 20, 2003, and entitled Grooming/Cleaning Apparatus which is a continuation-in-part of co-pending application Ser. No. 10/672,909, filed Sep. 26, 2003, and entitled Lint Removal Apparatus with Edge Orientation, the contents of both of which are incorporated herein in their entirety.

BACKGROUND

This invention relates to cleaning apparatus and, in particular, to cleaning apparatus for dishes, glasses and tableware.

Cleaning apparatus for dishes, glasses and tableware has taken many shapes and forms. Brushes have been devised for cleaning the inside of glasses as well as to scrub hard-to-remove food from the surface of plates and tableware.

Certain brushes have been devised to carry a supply of cleaning fluid, such as dishwashing liquid, in a container which can be dispensed through the brush bristles by pushing a button on the brush handle.

Motorized dish cleaning devices have also been devised. Such motorized brushes include a handle which houses a motor and a battery power supply. The motor output shaft extends axially from the handle and receives a replaceable brush head in a snap-on fit.

However, it is believed that improvements can be made to motorized cleaning apparatus and, in particular, to motorized dish and glass and tableware cleaning apparatus.

SUMMARY

In one aspect of the present invention, a cleaning apparatus includes a support handle, a rotatable shaft of power drive means, axially extends from the handle, and a cleaning element mounted on the rotatable support.

In one aspect, the cleaning element is a mat having an exterior surface formed as a cleaning surface. A plurality of bristles may also extend from the support.

Clamp means may also be provided on the support or the mat or can be separably attachable to the support or the mat to clamp the mat to the support.

In another aspect, the cleaning element further includes an attachment carrying an auxiliary cleaning element mountable on the end of the support. The auxiliary attachment can be snap fit or threaded on the end of the support. Cleaning bristles of one or more different materials and/or shapes may be mounted on the attachment.

In another aspect, the support defines a liquid container for carrying a cleaning media, such as dishwashing liquid or water. An aperture is formed in the container for dispensing the cleaning media from the container to the cleaning element mounted about the support. In one aspect, the aperture dispenses the cleaning media from the container only during rotation of the support by the power drive means.

In another aspect, valve means is mounted in the aperture and moveable from a first position sealingly closing the aperture and a second position opening the aperture to fluid flow. In yet another aspect, the support means may be defined entirely by a liquid container which itself is connectable to the power drive means. The cleaning element is carried on at least one of a sidewall and an end wall of the container.

The motorized cleaning apparatus of the present invention provides an expeditious device to clean glasses, plates and tableware while at the same time allowing a number of different cleaning elements to be removably mounted on the rotatable support.

DETAILED DESCRIPTION OF THE DRAWING

The various features, advantages and other uses of the present invention will become more apparent by referring to the following detailed description and drawing in which.

DETAILED DESCRIPTION

Figure 1:
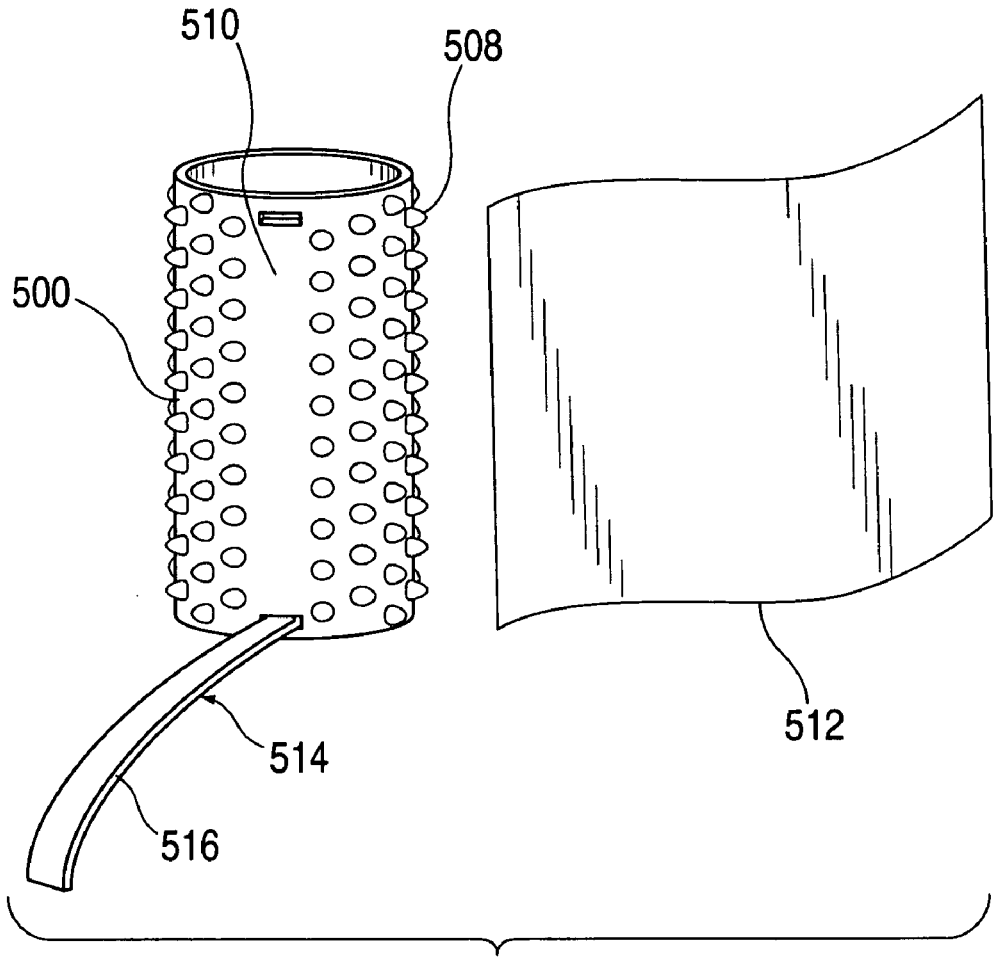
FIG. 1 is an exploded perspective view of a cleaning element according to the present invention.

FIG. 1 depicts a cleaning element 500 usable on the present invention in which the cleaning element 500 includes a space 510 which is at least partially void of the projections 508. A clamp, such as a hair barrette type clamp 514 is mounted on the mat and has a pivotal bar 516 which is extendable over a substantial portion of the width of the cleaning element 500. A wipe sheet 512 can be wound around the cleaning element 500 and the ends clamped in place by clamping of the pivotal bar 516 and the remainder of the clamp on the cleaning element 500. In this manner, the projections deform the sheet 512. The wipe sheet, preferably is a non-woven spunlace fabric, 20 gsm to 120 gsm pre-treated with cleanser, etc. The preparation is either activated by water by the user or pre-moistened and ready to use.

Figure 2:
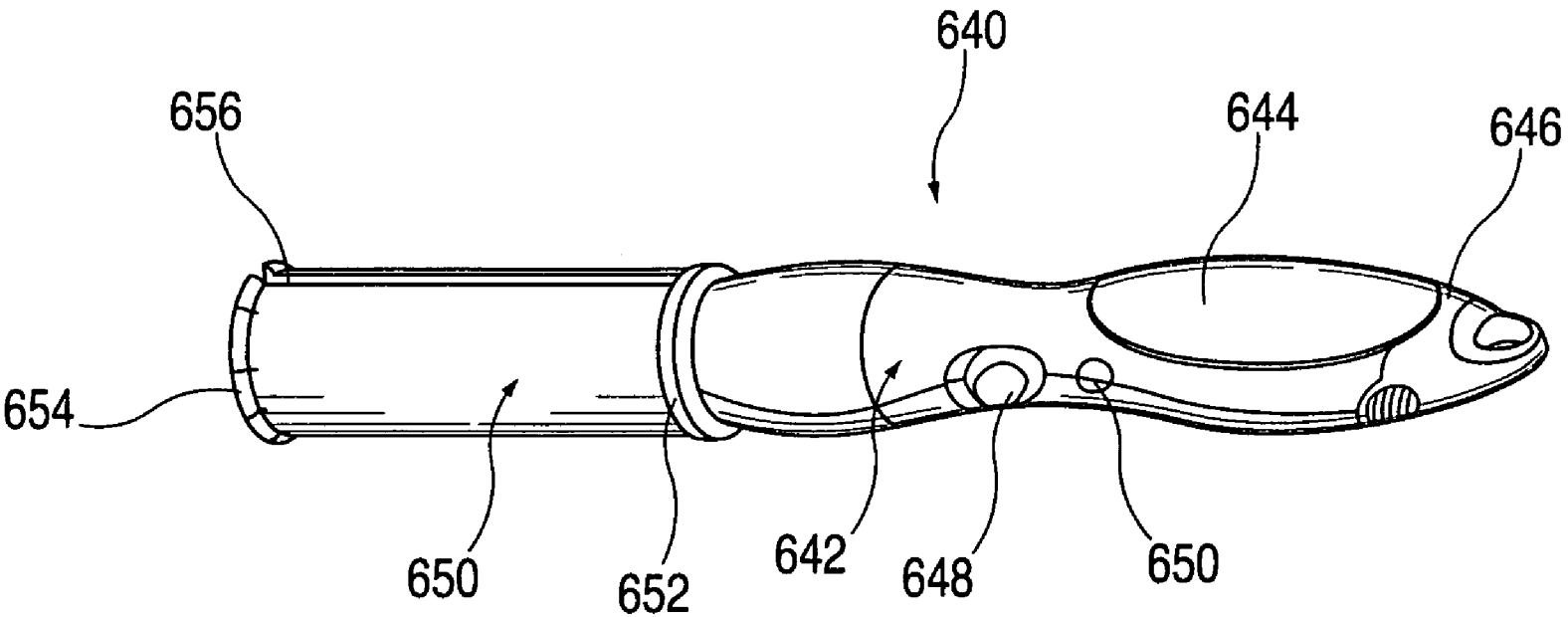
FIG. 2 is a perspective view of a handle and spindle according to the present invention.

In FIG. 2, a cleaning apparatus 640 is depicted. The apparatus 640 includes a handle assembly 642 formed of a substantially aesthetically shaped, rigid outer shell with moisture proof gasketing which may include one or more resilient material pads 644 to facilitate gripping. A removable or hinged battery cover 646 is attached to one end of the handle 642 to allow access to a battery compartment housed interiorly within the handle assembly 642.

A drive motor means is mounted internally within the handle assembly 642. A slow/fast speed control button 648 and a separate forward and reverse control button 650 are mounted on the handle assembly 642 and connected by switchable contacts to the motor housed within the handle assembly 642 for controlling the activation and deactivation of the motor as well as the direction of rotation of the motor shift.

In this aspect, the output shaft of the motor, not shown, is connected to a key slot or bore in a spindle 650 which is formed of a generally cylindrical body with a first annular flange 652 at one end adjacent to the handle assembly 642 and an enlarging or flange 654 at an opposite end. The flange 654 may have a plurality of radially extending discontinuities to form individual sections which are moveable to allow the mounting of a cleaning or grooming element thereover as described hereafter. A small gap or slot 656 is formed along the longitudinal length of the surface of the spindle 650 to allow a small degree of compression and expansion of the diameter of the spindle 650 to accommodate cleaning attachments.

A number of different cleaning attachments, some suited for general purpose cleaning of many different surfaces and articles, and others more specific for cleaning specific articles may be mounted on the spindle 650.

Figure 3A:
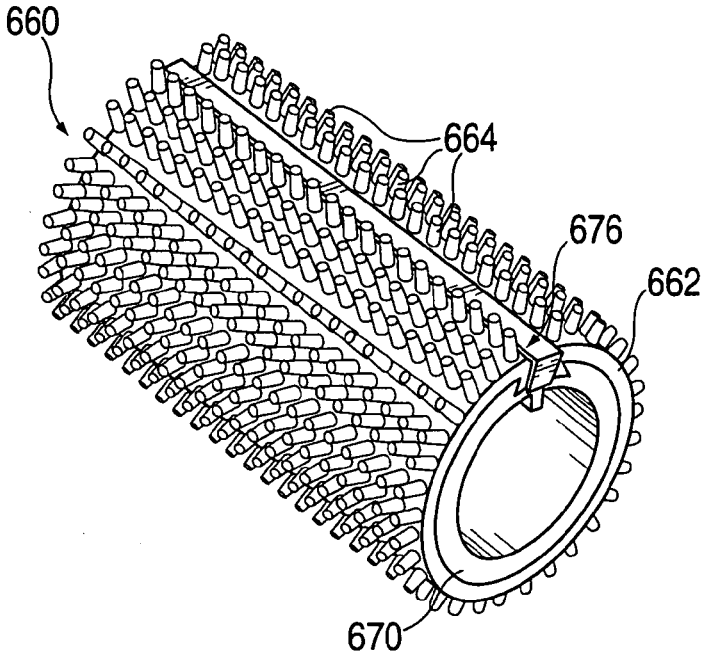
FIG. 3A is a perspective view of another cleaning element.
Figure 3B:
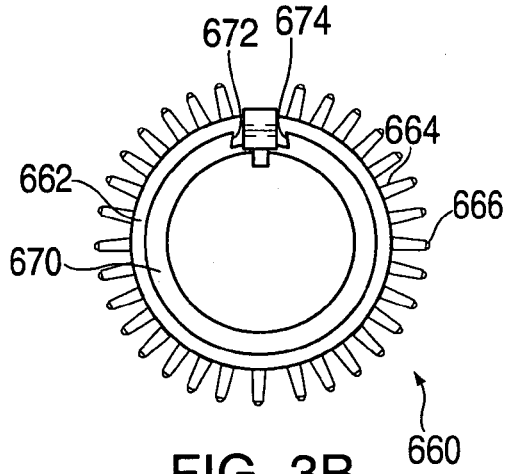
FIG. 3B is an end view of the cleaning element as shown in FIG. 3A
Figure 4:
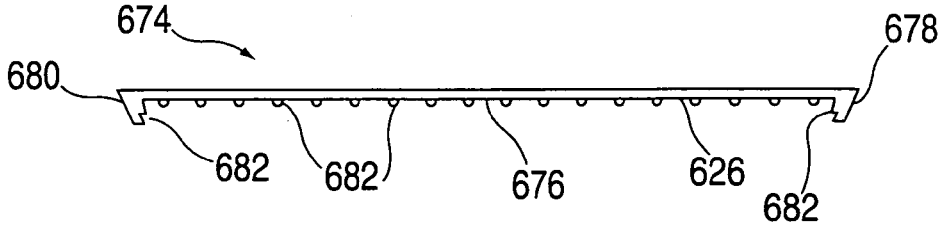
FIG. 4 is a perspective view of a clamp usable with the cleaning element shown in FIG. 3.

One such cleaning element 660 is shown in FIGS. 3A, 3B and 4. The element 660 is in the form of a mat or pad having a generally cylindrical shape when in a use position. The pad 660, in this aspect is formed of a resilient material, such as an elastomer, rubber, or soft plastic having a substrate 662 from which radially project a plurality of conical or cylindrical bristles 664. The bristles 664 are each resilient themselves and are arranged in close proximity to cover a substantial portion of the exterior of the substrate 662. As shown in FIG. 3B, a small nib 666 may optionally be formed on the end of each bristle 664.

The substrate 662 and the bristle 664 may be molded or otherwise formed as a unitary; homogeneous member in either a sheet form or a closed, continuous cylindrical form. The use of a sheet form for the pad 660 enables mounting of the pad 660 over a generally tubular or cylindrical core 670. The core 670 has a longitudinally extending clamp groove formed by opposed clamp surfaces 672 and 674. Clamp surfaces 672 and 674, which form one-half of a dove-tail shape, are adapted for receiving mating angled ends of the substrate 662 which snap-fit into the clamp groove to mount the substrate 662 about the core 670.

A separate clamp 626 may then be mounted over any area or portion of the substrate 662. In one aspect, the clamp 626 is mounted over a void or empty space along a longitudinal portion of the substrate 662. The clamp 674 which is shown in greater detail in FIG. 4, is formed of a resilient material, such as an elastomer, rubber, soft plastic, etc. and has a strip-like main portion 676 with first and second opposed ends 678 and 680. The strip portion 676 may include inward extending teeth or projections 682 to facilitate engagement with the substrate 662.

The first and second ends 678 and 680 of the clamp 674 have inward extending ends with teeth or serrations 682 on an inner surface. The first and second ends are adapted to engage recesses formed at the end of the clamp groove in the core 670, as shown in FIGS. 3A and 3B to snap-fit the clamp 674 on the pad 660 so as to cover and retain the ends of the pad 660 in place on the core 670. Optional teeth or projections form complementary to the teeth 682 on the inner surface of the ends 678 and 680 of clamp 674 may be formed in opposite ends of the core 670 to facilitate a secure, but releasable attachment of the clamp 674 to the core 670.

Figure 5:
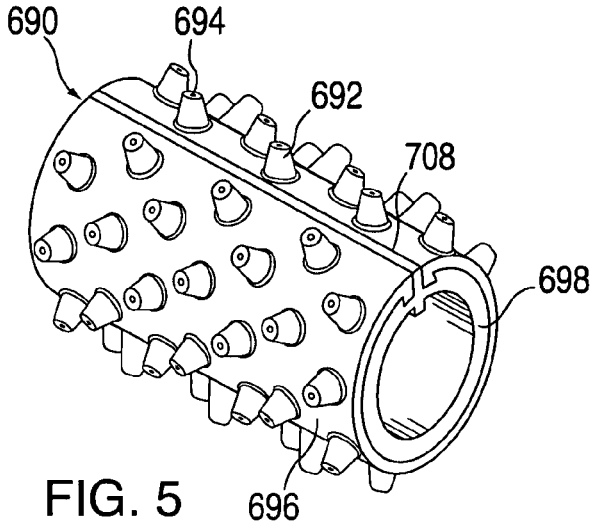
FIG. 5 is a perspective view of another aspect of a cleaning element or mat according to the present invention.
Figure 6:
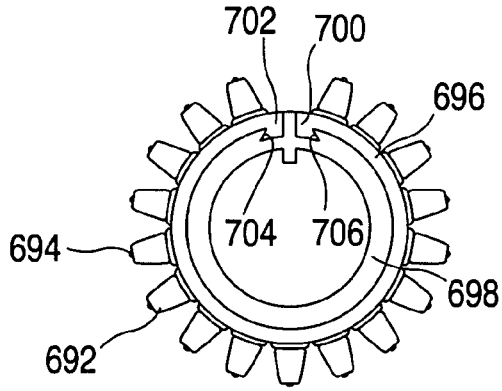
FIG. 6 is an end view of the cleaning element shown in FIG. 5.

Referring now to FIGS. 5 and 6, there is depicted another mat or pad 690 mountable on the one of the spindles of the present invention. The pad 690 includes a plurality of larger conical shaped projections 692, each terminating in a small nib 694, by example only. The conical shaped projection 692 are somewhat randomly spaced about a substrate 696 with which they form a homogenous body. The substrate 696 may be formed as a continuous closed cylindrical member, or as shown in FIGS. 5, 6, 7 and 8, as a sheet which wrapped around a tubular or cylyndrical core 698. Opposed ends 700 and 702 of the sheet 696 are complementary shaped to inverted angled edges 704 and 706 in a longitudinally extending discontinuity in the core 698 so as to mount the ends of the substrate 696 in the core 698 in a snap-fit. In this aspect, a thin rib 708 extends from the core 698 intermediate the inward facing edges 704 and 706 to separate the ends of the substrate 696 as shown in FIGS. 5 and 6.

Figure 7:
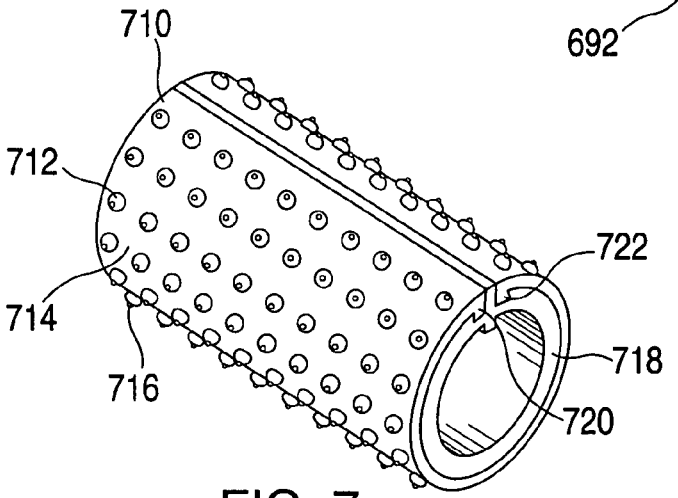
FIG. 7 is a perspective view of another aspect of a cleaning element or mat according to the present invention.
Figure 8:
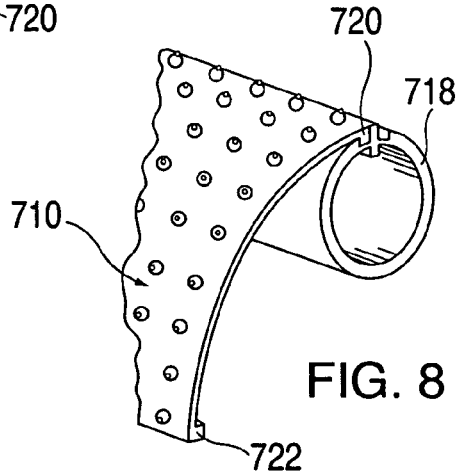
FIG. 8 is a partial, perspective end view of the cleaning element or mat shown in FIG. 7, but depicted in a partially assembled position about a core.

In FIGS. 7 and 8, there is depicted a similar pad 710 with a plurality of smaller projections 712 closely spaced on a substrate 714. Each projection 712 terminates in an end nib 716, again by example only. The substrate 714 is mounted on a core 718 by means of complementary recesses for receiving the dove-tail shaped ends 720 and 722, of the sheet-like substrate 714 in a snap-in fit in the same manner as described above.

Figure 10:
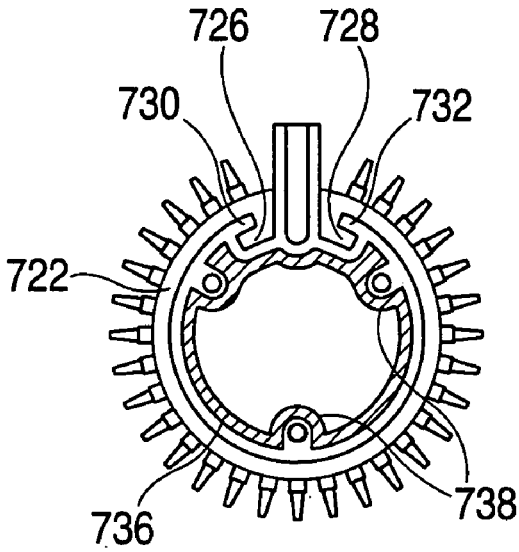
FIG. 10 is a cross-sectional view generally taken along line 10—10 in FIG. 9.
Figure 9:
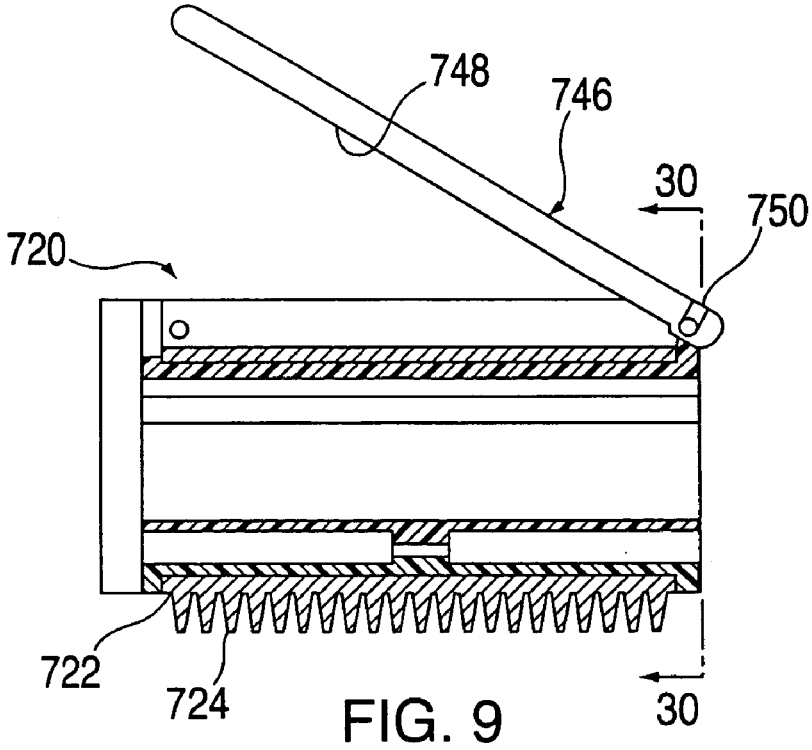
FIG. 9 is a partially cross-section, side elevational view of another aspect of a cleaning element or mat with a pivotal clamp according to the present invention.

FIGS. 9 and 10 depict an alternate pad 720 according to another aspect of the present invention. The pad 720 includes a substrate 722 from which extend a plurality of generally conical shaped nib 724 similar to the nibs 664.

The substrate 722 is by way of example only, divided in a sheet-like form with opposed ends terminating in fingers 726 and 728 which are spaced from the main portion of the substrate 722 by a slots 730 and 732. The substrate 722 is mountable around a core 736 which has a generally tubular, cylindrical cross section. By way of example only, a plurality, such as three, circumferentially spaced ribs 738 are formed interiorly of the core 736 and extend between opposite ends of the core 736. The rib 738, which may be hollow, provide an orienting feature for mounting the core 736 to a mating motor driven spindle, described hereafter, which has a plurality of circumferentially spaced recesses complimentary to the ribs 738 for slidably receiving the ribs 738 to mount the core 736 on the spindle.

The core 736 includes end fingers 740 and 742 which are circumferentially spaced apart and are adapted for engaging the slot 730 and 732 formed in the core 736 to mount the substrate 722 to the core 736. When the ends 726 and 728 of the substrate 722 are mounted on the core 736, as shown in FIG. 10, the inward facing surfaces of the ends 726 and 728 will be spaced apart by a channel.

A pivotal clamp member 746 in the form of an elongated bar which may have a smooth or toothed inner edge 748 pivotally connected at one end 750 to the core 736 by means of a pivot pin. The clamp 746 is pivotal from a first open position shown in FIG. 9 allowing mounting or dismounting of the substrate 722 on the core 736 and a second closed position in which the inner surface 748 of the clamp 746 engages an inner surface of the core 736. In this closed or second position, the clamp 746 is positioned between the inward facing ends of the substrate 722 thereby preventing dislodgement and separation of the ends 726 and 728 of the substrate 722 from the core 736.

Figure 11:
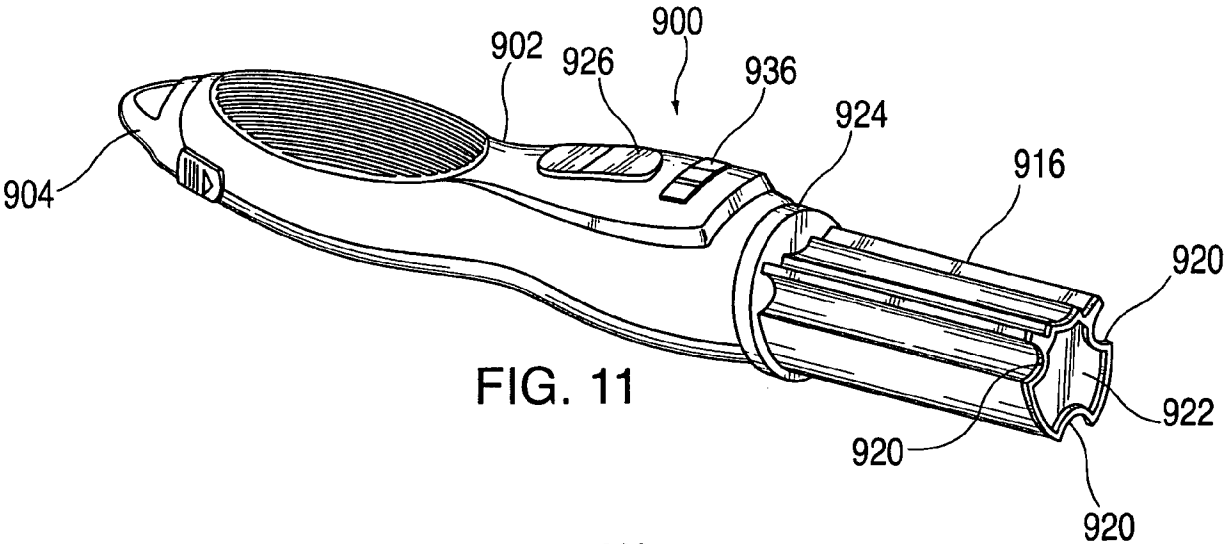
FIG. 11 is a perspective view of another aspect of a cleaning apparatus providing a rotatable spindle according to the present invention.
Figure 12:
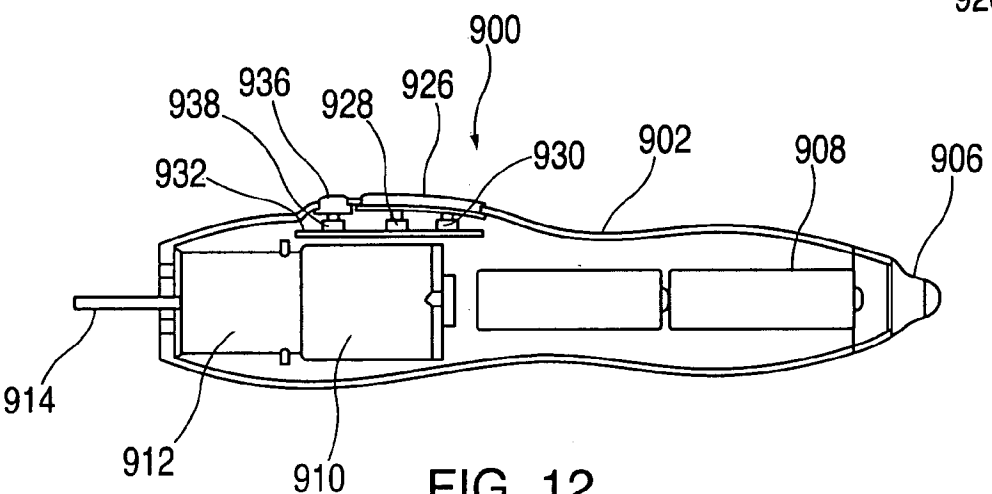
FIG. 12 is a side elevational view, with a portion of the housing removed, to show the internal components of the cleaning apparatus shown in FIG. 11.

Referring now to FIGS. 11 and 12, there is depicted another aspect a motorized cleaning apparatus 900 according to the present invention. The apparatus 900 includes a handle housing 902 with a pivotal or removable end cap 904 allowing access to an internal compartment for storage batteries 908.

A bi-directionally rotatable motor 910 is mountable with in the housing 902. The output shaft of the motor is coupled to a transmission or clutch 912. An output shaft 914 projects from the transmission 912 externally at one end of the housing 902. The output of drive shaft 914 is fixedly coupled to a rotatable support, such as a rotatable spindle 916 shown in FIG. 11. Although the spindle can take any cross-sectional shape, by way of example only, the spindle has a generally circular cross-section with a plurality, with three being depicted by way of example only, of longitudinally extending arcuate recesses 920. The recesses 920 are adapted to mate with the longitudinally extending enlargement 738 in a cleaning element core or support as shown in FIG. 10 to fixedly couple the cleaning element to the spindle 916 for bi-directional rotation with the spindle 916.

An end cap 922 may be provided on one end of the spindle 916 to prevent the entry of water or debris into the typically hollow interior of the spindle 916.

Similarly, a cap with a dependent sidewall 924 is formed at the other end of the spindle 916 and covers the open area or gap between the end of the spindle 916 and the adjacent end of the housing 902 to again prevent the entry of water or debris into contact with the drive shaft 914. The buttons may be designed with elastomeric material to seal out water.

Suitable control switches or push buttons may be provided on the housing 902 to control the speed and the direction of rotation of the drive shaft 914. A forward and reverse slide or rocker switch 926 may be mounted on the housing. The switch activates contacts for micro switches 928 and 930, shown in FIG. 12, are mounted on a circuit board 932 in the housing 902. Conductors or wires extend from the circuit board 932 to the motor 910 to supply electric power from the batteries 908 to the motor 910. A speed control switch 936, depicted as having two speeds, namely, fast and slow, is also mounted on the housing 902. The switch 936 is also connected to contacts or a microswitch 938 on the circuit board 932 and, controls the polarity of the electric power supply to the motor 910 to control the direction of rotation of the output drive shaft 914 of the motor 910.

It will be understood that the motor 910 may also be a single direction rotatable motor. The motor may also provide one or more speeds. Thus, the motor 910 can provide a single speed of rotation in a single direction, one or more selectable speeds of rotation in one or more directions of rotation, or a variable speed of rotation in one or more directions.

It will also be noted that in all aspects of the invention which mount a motor in the cleaning apparatus, a sound proofing material, such as the foam material used to form compressible ear plugs, which may have a high noise filtration (NRR) of 33 decibels, for example, may be mounted on or applied to the exterior or interior of the handle depending on the suitability of the selected material for use as an external gripping surface or, when mounted internally within the handle, having suitable temperature resistance, electrical and vibration absorbing insulative properties.

Figure 13:
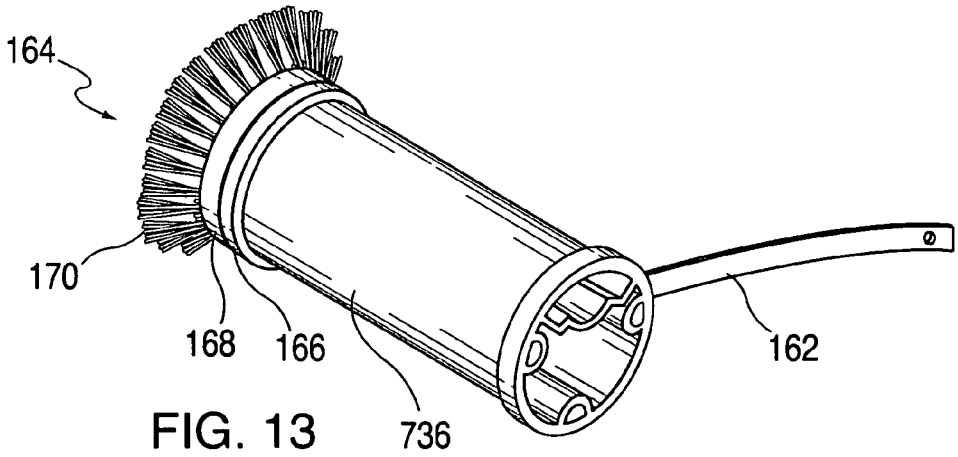

Referring now to FIG. 13, there is depicted the core 736 which fits over the mandrel or spindle coupled to and rotated by the motor output shaft extending axially from the handle shown in FIG. 2. A pivotal clamp bar 162 is coupled to the core 736 and is devised for clamping various cleaning elements on the core 736, as described hereafter.

An end bristle attachment 164 may be permanently or separably mounted by a snap-fit, for example, to an end 166 of the core 736. The attachment 164 includes a base 168 from which extend a plurality of bristles 170. The bristles may be formed of a soft material, such as nylon for scrubbing the ends of glasses, dishes as well as tableware, as well as radiused areas of pots and pans.

Figure 15:
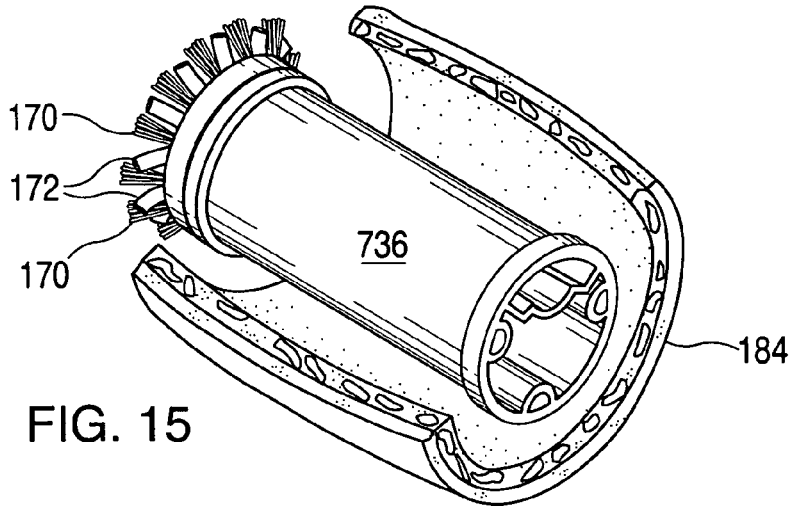
FIGS. 13, 14 and 15 are perspective views of different aspects of the cleaning apparatus according to the present invention.

Referring briefly to FIG. 15, a different arrangement of bristles in which the nylon brush bristles 170 alternate with harder, rubber or elastomeric bristles 172.

Figure 14:
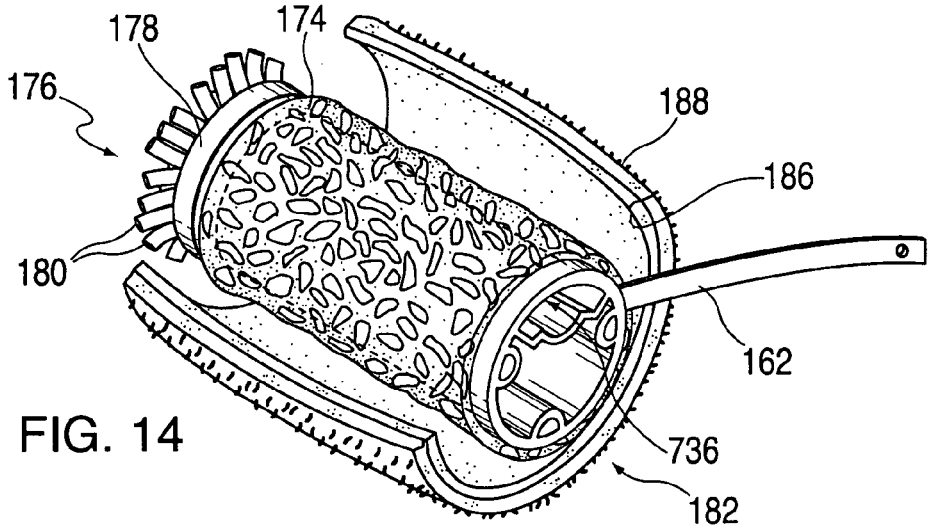

As shown in FIG. 14, the surface of the core 736 may be covered by a fixed or removable soft material, such as a soft sponge or foam 174 to enable the attachment to conform to the shape of dishes, glasses, etc. In the attachment 176 shown in FIG. 14, an end attachment 178 is illustrated by example only as carrying semi-rigid rubber or elastomeric bristles 180. The attachment 178 is fixedly mounted on one end of the core 736 or is separably attached thereto by a screw or snap-on connection.

A separate cleaning element 182 may be removably mounted about the core 736. The cleaning element 182 can be any cleaning element suitable for cleaning dishes, tableware, glasses, etc. For example, a Palmolive brand wipe 182 is shown in FIG. 15. This dish wipe 182 is a sturdy triple layer wipe which is pre-treated with dishcleaning liquid and supplied dry so as to be water activated. The wipe 184 depicted by example in FIG. 14 is a Church and Dwight Brillo brand Scrub and Toss Scrubber with a soft side 186 and a scouring side 188.

Both wipes 182 and 184 can be supplied in a cylindrical shape and press fit over the core 736. This enables the wipes 182 and 184 to be easily disposed of and replaced with a fresh wipe to prevent the growth of bacteria.

The wipes 182 and 184 can also be provided in a mat or sheet form and wound about the core 736. The ends of the wipes 182 and 184 may be releasably fixed on the core 736 by means of the pivotal clamp 162 which is pivoted and locked in general parallel alignment with the core 736 over the ends of the cleaning elements 182 and 184.

Figure 16:
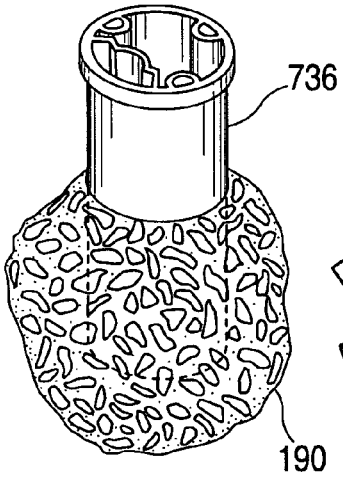
FIGS. 16, 17 and 18 are perspective views of other aspects of a cleaning apparatus according to the present invention.
Figure 17:
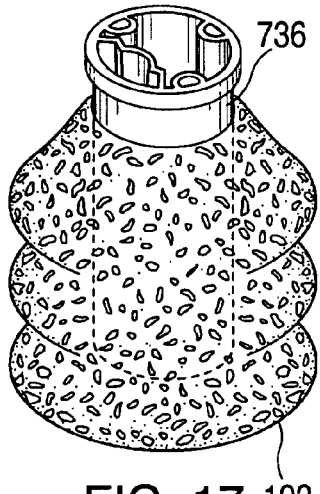

FIGS. 16, 17, 18 and 19 depict alternate cleaning elements mountable on the core 736. In FIG. 16, a round foam or sponge 190 is fixed about one end of the core 736. The foam or sponge element 190 extends over at the least the end portion and preferably, over a considerable length of the core 736. In FIG. 17, a cleaning element 192 having an irregular, elongated shape is mounted over the core 736 and covers substantially all the core 736. The cleaning element 192 may also be formed of a foam or sponge material.

Figure 18:
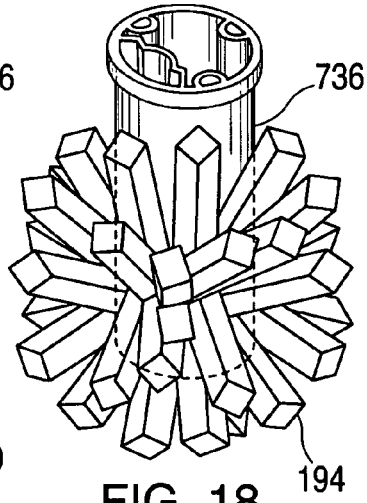
Figure 19:
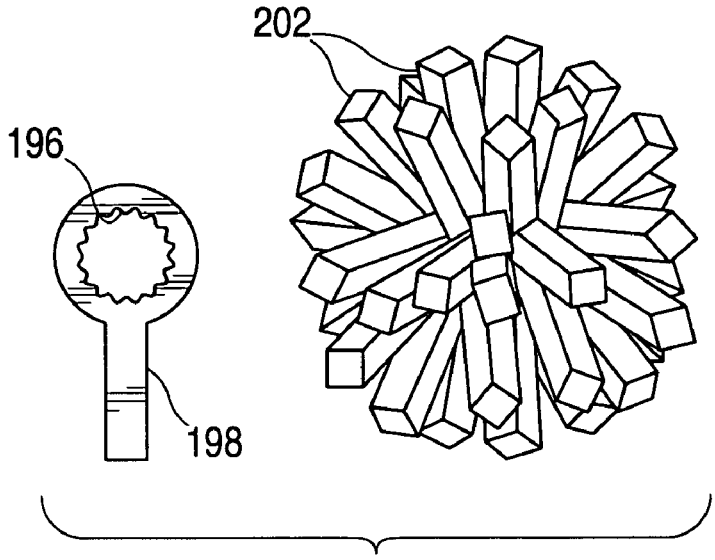
FIG. 19 is an exploded, perspective view showing the elements of the cleaning apparatus shown in FIG. 18.

FIGS. 18 and 19 depict an "octopus" cleaning element in which a sheet of foam or sponge material is formed with aligned pairs of edge cuts. The solid center portion of the sheet is forced through an aperture 196 in a holder 198 which is snap engagable in one end of the core 736 by means of inter-fitting end shapes or attached to the motor shaft.

In forming the cleaning element 194, a solid sheet is formed with aligned pairs of edge cuts. The solid center portion of the sheet is forced through an aperture 196 and a holder 198 causing the cut ends to project erratically in a generally irregular spherical shape as shown in FIG. 19. The holder 196 is removably coupled to one end of the core 736 by means of a complementary recess in the end of the core or by means of a suitable chuck on the end of the core 736. Alternately, the holder 196 may be formed with a suitably shaped internal bore which receives one end of a spindle extending outward from the motor in the handle.

Figure 20:
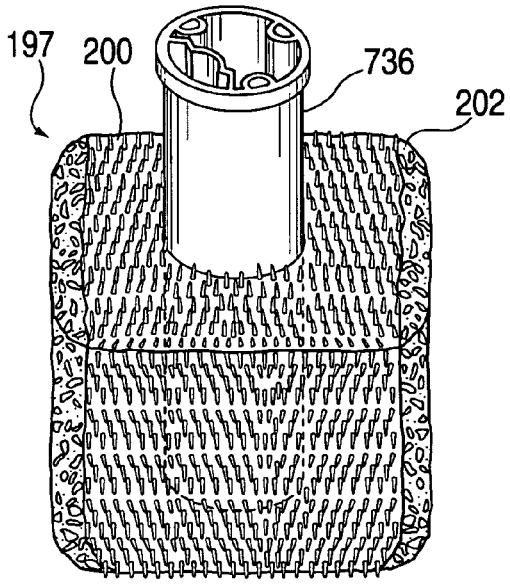
FIGS. 20, 21, 22, and 23 are other aspects of a cleaning apparatus according to the present invention.
Figure 21:
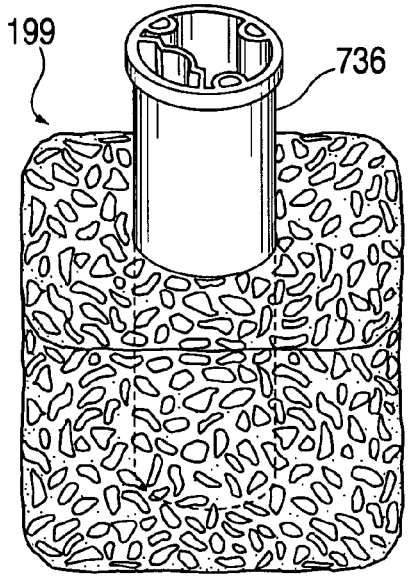

FIGS. 20 and 21 respectively depict cleaning elements 197 and 199 releasably or fixedly mounted on the core 736. The cleaning element 197 includes a scouring surface 200 which may be formed of a rough surface or bristles formed of nylon, etc. A sponge or foam exterior section 202 is formed along the edges and end of the portion 200.

The cleaning element 199 shown in FIG. 21 also has a generally rectangular shape, in this example, is formed entirely of sponge or foam.

Figure 22:
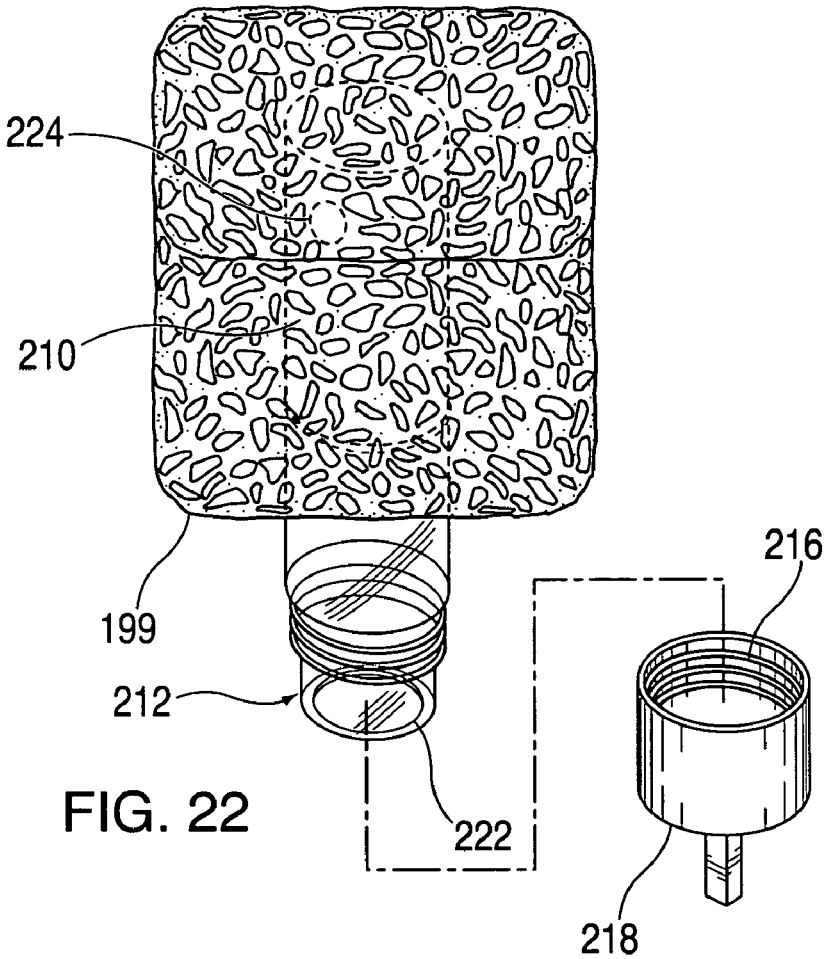

FIG. 22 depicts the cleaning element 199 shown in FIG. 21 and described above mounted on a body 210 which is formed as a liquid holder and dispenser container. One end 212 of the body 210 is formed with external threads, by example only. The threads engage mating threads 216 in a chuck 218 which is releasably attachable to the spindle or output shaft of the motor in the handle. When the body 210 is unthreaded from the chuck 216, an opening 222 is exposed in the end of the body 210 which can be used as a filling aperture for adding a fluid cleaner to the container or body 210. The threads on the body 210 are formed to thread on to the threads 216 in the chuck 218 oppositely from the direction of rotation of the motor output shaft to prevent unthreading of the body 210 motor operation.

An aperture 224 is formed in the container 210 in a location which will be encompassed by the cleaning element 198. It will be understood that any of the cleaning elements described above, such as cleaning elements 182, 184, 190, 192, 194 and 198 may also be employed with the liquid dispensing body 210.

The aperture 224 is precisely sized to allow the liquid contents of the container 210 to be centrifugally flung outward into the cleaning element 198 during rotation of the body 210 by the drive motor in the handle. Since the cleaning element 198 will be wet, the cleaning liquid will create suds to facilitate cleaning of dishes, glasses, tableware, etc.

Figure 23:
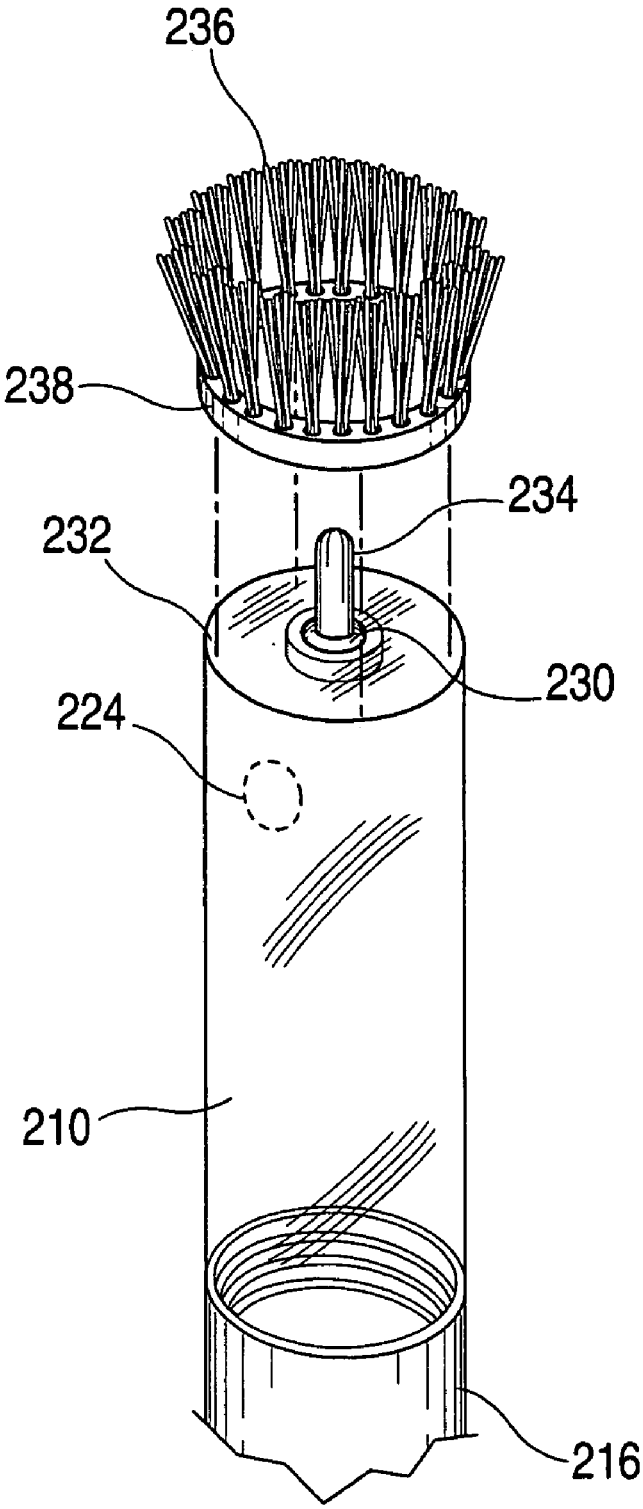

FIG. 23 depicts an alternate aspect in which the liquid dispenser body 210, with or without the dispensing aperture 224 in sidewall, is provided with an aperture 230 in an end wall 232. A movable plunger 234 is retained in the aperture 230 and has an end extending therethrough in the bristles 236 on an end attachment cap 238 which is threaded or snap fit to the end of the container 210. Engagement of the bristles 236 with an object to be cleaned will deform the bristles 236 sufficiently to enable the plunger 234 to be forced into the interior of the container 210 thereby opening the aperture 230 and allowing the dispensing of liquid cleaner from the container 210 to the bristles 236 wherein it is applied to the object being cleaned. Separation of the bristles 236 from the object being cleaned causes the plunger 236 to extend to its fullest extent through the aperture 230 sealing the aperture 230 and preventing the further flow of liquid from the interior of the container 210 through the aperture 230.

It will be noted that the aperture 230 may be used by itself or in conjunction with the sidewall aperture 234 where a separate cleaning element is mounted about the sidewall of the container 210.

It will also be noted that the aperture 222 in the liquid container 210, shown in FIG. 22 may be provided with a removable plug or cap which holds the liquid cleaner in the container 210 in the replacement package used to sell the liquid container 210 and attached cleaning elements as a replaceable cleaning element attachable to a handle of the present invention as well as after each refilling of the container with new liquid cleaner.

It will also be understood that the liquid container 210 shown in FIGS. 22 and 23 may be used to serve the same function as the core 736. In this aspect, the liquid container 210 receives an end bristle attachment, such as attachment 238 shown in FIG. 22 by itself or alternately only or in combination with the end attachment 238 a cleaning element mounted about the sidewall of the container 210, such as the cleaning element 198 shown in FIG. 22 or in any of the other cleaning elements described above. Any cleaning element mounted on the sidewall of the container 210 can be permanently affixed, provided in a snap-over cylindrical fit or applied in a mat form and wound about the sidewall 210 and held in place by a clamp, clip or other fastener means.

What is claimed is:

1. A cleaning apparatus comprising:

a cleaning element support;

a cleaning element removable mounted about the support and having opposed ends;

a handle coupled to the support, the handle rotatably coupled to the support;

powered drive means, carried in the handle and having a rotatable output shaft to the support, for rotating the support upon activation of the powered drive means clamp means, carried on the support;

a slot formed in the support with the opposed ends of the cleaning element secured in the slot, said slot receiving said clamp means so as to engage said opposed ends to prevent dislodgement thereof from said slot.

2. The apparatus of claim 1 wherein the cleaning element comprises:

an exterior surface with cleaning members fixed thereto and radially projecting therefrom.

3. The apparatus of claim 1, wherein the clamp means comprises:

a pivotal member carried on the support, the clamp means pivotal between a first position spaced from the support to a second position engaged with the opposed ends of said cleaning element.

4. The apparatus of claim 1, further including means carried on the opposed ends of the cleaning element for releasably mounting said opposed ends in said slot.

5. The apparatus of claim 1 wherein:

the cleaning element extends over substantially an entire exterior surface of the support.

6. The apparatus of claim 1 further comprising:

an attachment carrying an auxiliary cleaning element mountable on an end of the support.

7. The apparatus of claim 6 wherein:

the auxiliary attachment is releasably mountable on an end of the support.

8. The cleaning apparatus of claim 1 wherein the support comprises:

container means for carrying a fluid; and an aperture formed in the container means for dispensing fluid from the container means to the cleaning element.

9. The apparatus of claim 1, wherein said support has a cylindrical configuration.

10. The apparatus of claim 1, wherein a space is defined between said opposed ends and said slot of said support is located along said space.

11. The apparatus of claim 1, wherein said clamp means has first and second ends with teeth for selectively engaging recesses formed at either end of the support slot.

12. A cleaning apparatus comprising:

a cleaning element support;

a cleaning element removably disposed about said support;

a handle coupled to the support;

powered drive means in the handle for selectively rotating the support relative to the handle;

a slot formed along the support;

wherein opposed ends of the cleaning element are selectively disposed in said slot for securing the cleaning element in fixed position on the support; and clamp means carried on the support for moving between a first open position and a second closed position, said second closed position having the clamp means positioned in said slot and between said disposed opposed ends of said cleaning element for preventing dislodgement thereof from said slot.

13. The apparatus of claim 12, wherein said slot includes a running rib for separating the opposed ends of the cleaning element when said ends are mounted in said slot.

14. The apparatus of claim 12, wherein said support has a cylindrical configuration.

15. The apparatus of claim 12, wherein said cleaning element has an exterior surface with a plurality of cleaning element projections fixed thereto and radially projecting therefrom.

16. The apparatus of claim 12, wherein said support includes a core having circumferentially spaced interiorly formed ribs for selectively mating with circumferentially spaced recesses of a rotatable spindle extending from said handle.

17. A cleaning apparatus comprising:

a cleaning element support;

a cleaning element removably disposed about said support;

a handle coupled to the support;

powered drive means in the handle for selectively rotating the support relative to the handle;

a slot formed along the support;

wherein opposed ends of the cleaning element are selectively disposed in said slot;

wherein the support carries a clamping device selectively receivable in said slot when said opposed ends are disposed in said slot for engaging said opposed ends in order to secure the cleaning element in fixed position on the support.

18. The apparatus of claim 17, wherein said support has a cylindrical configuration and said cleaning element is in the form of a sheet or a tube.

* * * * *